United States Patent [19]

Lawson

[11] Patent Number: 4,601,414

[45] Date of Patent: Jul. 22, 1986

[54] SUSPENDED HOPPER BIN FLOW ENHANCER

[76] Inventor: John D. Lawson, R.R. #1, Box 83, Leesburg, Ind. 46538

[21] Appl. No.: 591,680

[22] Filed: Mar. 21, 1984

[51] Int. Cl.[4] ..... B67D 3/00

[52] U.S. Cl. ..... 222/564; 52/192

[58] Field of Search ..... 222/564, 460, 547; 52/197, 192; D11/121

[56] References Cited

U.S. PATENT DOCUMENTS

| | | | |
|---|---|---|---|
| 836,509 | 11/1906 | King | 222/564 |
| 1,995,551 | 3/1935 | Shodron | 52/192 |
| 2,673,285 | 3/1954 | Buschi | D11/121 |
| 2,778,157 | 1/1957 | Gratzer | D11/121 |
| 3,193,058 | 7/1965 | Ebbinghaus | 52/192 |
| 3,302,833 | 2/1965 | Leika | 222/564 |
| 4,382,723 | 5/1983 | Muller | 222/564 |

FOREIGN PATENT DOCUMENTS

| | | | |
|---|---|---|---|
| 1142792 | 4/1959 | Fed. Rep. of Germany | 52/192 |
| 2344782 | 3/1974 | Fed. Rep. of Germany | 222/564 |
| 8002874 | 12/1981 | Netherlands | 52/192 |
| 2083009 | 1/1982 | United Kingdom | 222/564 |
| 844744 | 7/1981 | U.S.S.R. | 52/192 |

*Primary Examiner*—Joseph J. Rolla
*Assistant Examiner*—Kenneth Noland
*Attorney, Agent, or Firm*—Roger M. Rickert

[57] ABSTRACT

A flow enhancement device for suspension within the storage bins having gravity fed lower output openings is disclosed and includes a diverging upper portion for diverting downwardly moving material radially outwardly as that material moves downwardly along the upper portion along with a lower portion having side walls more vertically inclined than the diverging upper portion to create a low pressure shearing region through which the material may fall toward the outlet. The lower portion may be provided with a series of projections for both inducing a circumferential component to the material flow and moving the enhancement device somewhat so as to dislodge entrapped materials in the bin. And to cause the opening at the bin exit to remain at a low pressure and to be always opened to material flow.

14 Claims, 3 Drawing Figures

SUSPENDED HOPPER BIN FLOW ENHANCER

BACKGROUND OF THE INVENTION

The present invention relates generally to the improvement of flow characteristics of materials from storage bins and more particularly to a device which may be suspended within such a storage bin to direct the material flow and on occasion to agitate the material so as to provide a uniform material flow from the bin.

It is well known that in draining materials from storage containers by gravity flow, irregularities in that flow within the container may occur. For example, in hopper bins used to store feed for cattle or poultry or other grain-like materials, flow variations due to variations in particle size may result in a lack of uniformity of the material exiting the bin. Also, material may adhere to or build up on side wall portions of the bin resulting in a funneling type flow or the creation of voids within the material, often referred to as arching or bridging, as well as numerous other flow irregularities. In such hoppers where material is added to the top of the hopper and withdrawn from an outlet at the bottom of the hopper, the pressure at the hopper outlet due to the weight of the material in a comparatively full hopper bin may cause difficulties either in opening and closing an outlet control or difficulties with schemes for removing the material from that outlet location. An example of this last problem would be undue pressure exerted on a conveyor system at the outlet of a hopper bin. Such pressure may result in a grinding of material, and for example, with pelletized feeds, undesirable variations in the composition of the material being dispensed.

Inserts for hopper bins have been suggested, however, typically such inserts form the bin outlet valving arrangement as, for example, illustrated in U.S. Pat. Nos. 1,147,325; 1,736,673; 3,556,469; and 4,410,111. In this last mentioned patent, a conical member is suspended from the roof of the bin by three cables connected to the cone pinnacle while the circular base of the cone selectively engages the portion of the bin tapering toward the bin outlet to form a valve closing the bin outlet. Shortening the suspension cables raises the cone allowing an annular flow of material around the cone base and out the hopper outlet. With this hollow conical valving device, material flow remains uneven around the entire circumference of the valve base edge due to the unit's ability to move substantially, off center, thus entrapping material against the nearest side.

Among the several objects of the present invention may be noted the provision of a flow enhancement device for suspension within a hopper bin which remains at a fixed elevation above the bin outlet regardless of whether material is being drained from the bin or not; the provision of a geometrical shape having limited angular and swinging mobility during material flow from a storage bin for reducing flow irregularities when material is allowed to drain from the bottom of such a bin; the provision of a scheme for introducing a device into a material flow path which device initiates numerous small avalanches of material so as to avoid a material build up which could result in a much larger avalanche of that material; the provision of a hollow flow enhancing device capable of selectively receiving ballast material to tailor the device to a particular material flow environment; and the provision of a material agitating device which may be suspended within a storage bin for reducing irregularities in material eminating from that bin. These as well as other objects and advantageous features of the present invention will be in part apparent and in part pointed out hereinafter.

In general, a flow enhancement device has a diverging upper portion for diverting downwardly moving material incident thereon radially outwardly as that material continues its downward motion along with a lower portion including generally vertical side walls past which the moving material may freely fall. The lower portion side walls need only be more vertically inclined than the diverging upper portion to create a low pressure shearing region through which the material may fall.

Also in general and in one form of the invention, a flow enhancement device to be suspended within a hopper bin near the bottom of the bin at a selected elevation above a bin outlet includes an upper frusto conical portion, a lower generally cylindrical portion and a plurality of flow deflecting fins extending outwardly from the cylindrical portion. Said fins offer two unique advantages: (1) to eliminate material entrapment against a sidewall (2) to cause rotational movement of device. The device may be formed as a one piece hollow geometrical shape of plastic or metal and may include a closable opening near an upper extremity for the optional addition of ballast to the device hollow interior. A loop may be formed integrally with the device near the upper extremity of the upper portion for receiving device suspending lines.

BRIEF DESCRIPTION OF THE DRAWING

Corresponding reference characters indicate corresponding parts throughout the several views of the drawing.

The exemplifications set out herein illustrate a preferred embodiment of the invention in one form thereof and such exemplifications are not to be construed as limiting the scope of the disclosure or the scope of the invention in any manner.

DESCRIPTION OF THE PREFERRED EMBODIMENT

Figure 1:
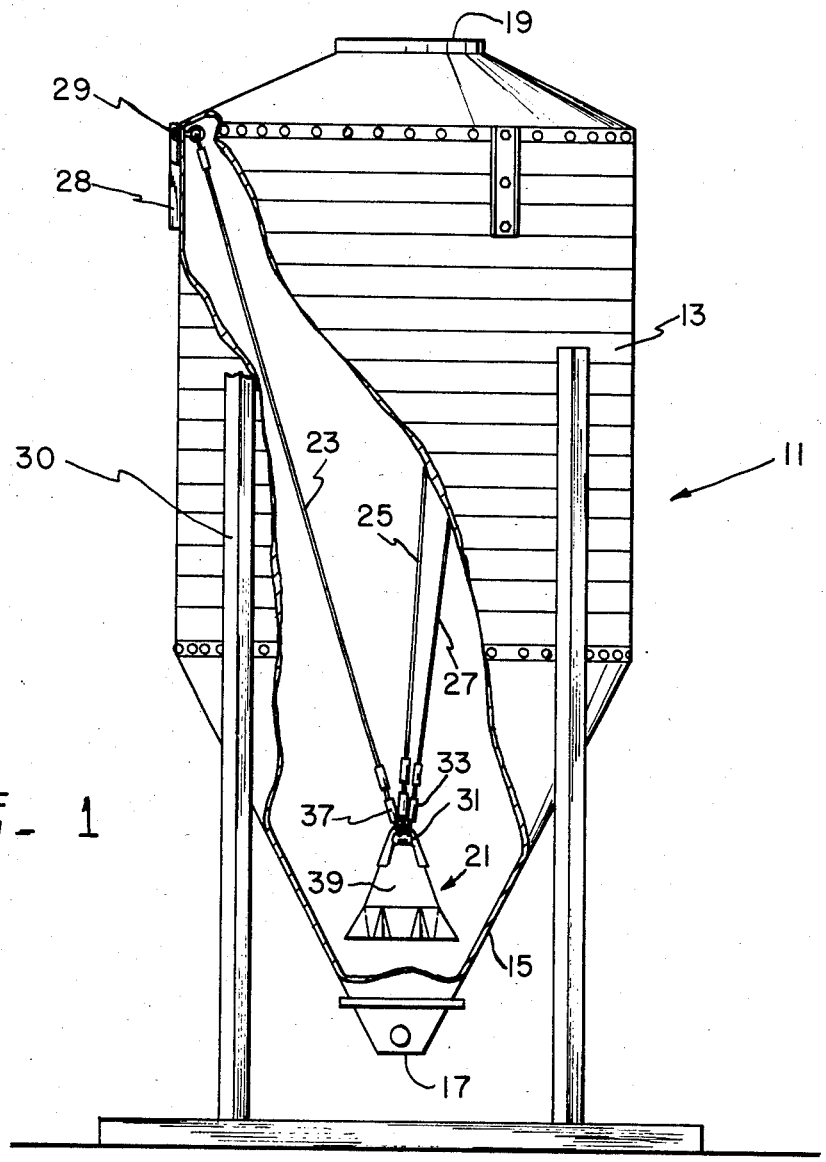
FIG. 1 is a side elevation view of a hopper bin partly broken away to illustrate the flow enhancement device suspended therein.

Referring first to FIG. 1, a storage bin such as hopper bin 11 of a type frequently experiencing material flow irregularities is illustrated as having an upper region 13 having generally vertical side wall portions and a lower region 15 where the side walls converge toward a bottom outlet 17. As is typical with such storage bins, the loading of material is accomplished through the top 19 of the bin and withdrawn from the bin through the outlet 17 at the bottom.

The flow enhancing device 21 is suspended within the bin a preferred distance above outlet 17 by three lines such as steel cables 23, 25 and 27 with the upper ends of those cables respectively attached to the upper part of the cylindrical portion 13 of the bin as, for example, by eye bolts such as 29 passing through the bin side walls. In some cases the eye bolts may pass through bin legs such as 30. U-shaped reinforcing brackets 28 may be used since the bin sidewall may be rather thin near the top of the bin. The cables 23, 25 and 27 are attached to the flow enhancement device by passing those cables through a loop or handle-like structure 31 optionally reinforced by gussets 52 near the top of the device and joining the cable free end back to the cable itself by means of conventional cable clamps such as 33, 35 and 37. As thus suspended the device 21 may rotate relatively freely about its vertical axis at least within limited angular ranges and further the device 21 may pivot in a somewhat pendulum-like manner about the general region of the loop 31.

Figure 2:
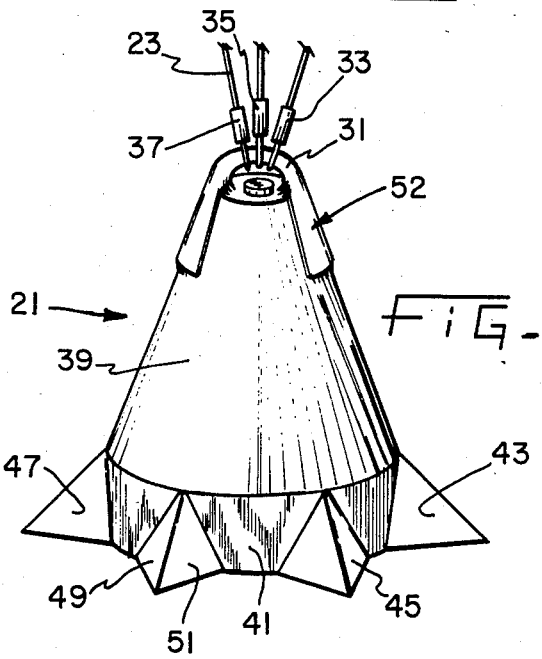
FIG. 2 is a perspective view of the flow enhancement device of FIG. 1.
Figure 3:
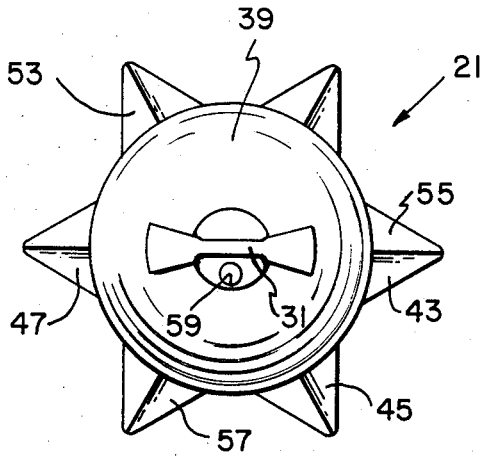
FIG. 3 is a plan view of the flow enhancement device of FIGS. 1 and 2.

Referring primarily to FIG. 2, the flow enhancement device 21 is seen to include a diverging upper portion 39 of generally frusto conical configuration which functions to divert downwardly moving material incident thereon radially outwardly as that material continues to move downwardly. The device itself includes a lower portion 41 of a generally cylindrical configuration having vertical side wall portions past which material may freely fall as well as having a plurality of flow deflecting fins such as 43, 45 and 47 which extend outwardly from the cylindrical portion with the sloping side walls of those fins or projections imparting a circumferential component to the flow of at least part of the material passing the device. Each fin or projection 43, 45 or 47 is formed in a generally pyramidal configuration having a pair of adjacent sloping side walls such as 49 and 51 for intercepting and diverting part of the material flow. In another version of the invention, it is contemplated that only one of the two sloping side walls such as 49 and 51 will be employed with the other side wall of the pyramidal projection being substantially vertical. Such vertical forming of a projection side wall could be staggered about the periphery of the lower portion as, for example, by omitting side wall surfaces 53, 55 and 57 only as viewed in FIG. 3.

The flow enhancement device 21 may be formed as a one piece hollow geometrical shape of a plastic material having an opening near the upper extremity of upper portion 39 closable, for example, by plug 59 so that if it is desired to increase the weight of the device, plug 59 may be removed and a selected quantity of water, sand or other ballast material added to the device hollow interior to increase its weight and/or inertia.

In operation, when material is being drained from the bin 11 that material is incident on the conical surface 39 and urged radially outwardly until the material flow reaches the upper edge of the lower cylindrical portion 41 wherein the abrupt change to a more vertical side wall configuration creates a low pressure shearing area past which the material may readily fall toward the outlet 17. This pressure reduction provides numerous advantages; for example if material is conveyed from the bin outlet, reduced pressure reduces the tendency for the conveying system to grind the material. Reduced pressure also eases opening and closing of the outlet as for example by a slide shutoff. The flow enhancement device 21 has a degree of mobility as material flows past the device and tends to move around somewhat dislodging entrapped material and avoiding the flow irregularities typical in such material storage bins.

From the foregoing it is now apparent that a novel flow enhancement device as well as a novel scheme for reducing flow irregularities within storage bins have been disclosed meeting the objects and advantageous features set out herein before as well as others and that modification as to the precise configurations, shapes and details may be made by those having ordinary skill in the art without departing from the spirit of the invention or the scope thereof as set out by the claims which follow.

What is claimed is:

1. A flow enhancement device formed as a one piece hollow geometrical shape for suspension within a material storage bin to reduce flow irregularities when material is allowed to drain from a lower region of the bin having a diverging upper portion for diverting downwardly moving material incident thereon radially outwardly as that material continues to move downwardly and having a lower portion including generally vertical side walls past which material may freely fall, means near the upper extremity of the upper portion for suspending the device with limited angular and swinging mobility, and a closable opening for the optional addition of ballast to the device hollow interior, and a plug for closing said closable opening for sealling the ballast therein.

2. The device of claim 1 further comprising a plurality of projections extending generally radially outwardly from the lower portion for imparting a circumferential component to the flow of at least part of the material passing the device.

3. The device of claim 2 wherein each projection is a generally pyramidal portion having a pair of adjacent sloping side walls for intercepting and diverting part of the material passing the device.

4. The device of claim 1 wherein the means for suspending comprises a loop formed integrally with the device near the upper extremity of the upper portion for receiving device suspending lines.

5. The device of claim 4 wherein the loop is adapted to receive at least three suspending lines closely adjacent one another to allow the device some freedom of movement including limited amounts of both rotational movement about a generally vertical axis through the loop and lateral swinging movement about the loop.

6. In combination with a hopper bin of the type having an upper region with generally vertical side walls and a lower region where side walls converge toward a bottom outlet, material being added to the bin at the top and withdrawn from the bin through the outlet at the bottom, a flow enhancing device suspended at a selected fixed elevation above the outlet within the bin lower region for limited rotational and swinging motion within the bin, the device formed as a one piece hollow geometrical shape and comprising an upper frustoconical portion, a lower generally cylindrical portion, means near the upper extremity of the upper portion for suspending the device with limited angular and swinging mobility, a plurality of flow deflecting fins extending outwardly from the cylindrical portion, and a closable opening for the optional addition of ballast to the device hollow interior.

7. The device of claim 6 wherein the lower portion side walls are generally vertically inclined.

8. The device of claim 6 further comprising a plurality of projections extending generally radially outwardly from the lower portion for imparting a circumferential component to the flow of at least part of the material passing the device.

9. The device of claim 8 wherein each projection is a generally pyramidal portion having a pair of adjacent sloping side walls for intercepting and diverting part of the material passing the device.

10. The device of claim 6 further comprising a loop formed integrally with the device near the upper extremity of the upper portion for receiving device suspending lines.

11. The device of claim 10 wherein the loop is adapted to receive at least three suspending lines closely adjacent one another to allow the device some freedom of movement including limited amounts of both rotational movement about a generally vertical axis through the loop and lateral swinging movement about the loop.

12. The device of claim 11 wherein the bin is provided with at least three brackets fixed to the bin near the upper end of the upper region, each bracket adapted to receive a corresponding suspending line to hang the device at a fixed elevation above the bottom outlet.

13. A flow enhancement device for suspension within a hopper bin near the bottom of the bin at a selected elevation above a bin outlet, the device formed as a one piece hollow geometrical shape and comprising an upper frustoconical portion, a lower generally cylindrical portion, means near the upper portion for suspending the device with limited angular and swinging mobility, a plurality of flow deflecting fins extending outwardly from the cylindrical portion, and a closable opening for the optional addition of ballast to the device hollow interior, and plug for closing said closable opening for sealing the ballast therein.

14. The device of claim 13 wherein the means for suspending comprises a loop formed integrally with the device near the upper extremity of the upper portion for receiving device suspending lines.

* * * * *